US012202636B2

(12) United States Patent
Karau

(10) Patent No.: US 12,202,636 B2
(45) Date of Patent: Jan. 21, 2025

(54) VENTED PACKAGING ARRANGEMENT AND METHOD

(71) Applicant: PAVESTONE, LLC, Atlanta, GA (US)

(72) Inventor: William H. Karau, Blanco, TX (US)

(73) Assignee: PAVESTONE, LLC, Atlanta, GA (US)

( * ) Notice: Subject to any disclaimer, the term of this patent is extended or adjusted under 35 U.S.C. 154(b) by 0 days.

(21) Appl. No.: 18/120,741

(22) Filed: Mar. 13, 2023

(65) Prior Publication Data

US 2023/0219705 A1 Jul. 13, 2023

Related U.S. Application Data

(62) Division of application No. 17/014,847, filed on Sep. 8, 2020, now Pat. No. 12,043,424.

(60) Provisional application No. 62/897,661, filed on Sep. 9, 2019.

(51) Int. Cl.
*B65B 11/58* (2006.01)
*B65D 75/00* (2006.01)

(52) U.S. Cl.
CPC ..... *B65B 11/585* (2013.01); *B65D 75/006* (2013.01); *B65D 2205/00* (2013.01)

(58) Field of Classification Search
None
See application file for complete search history.

(56) References Cited

U.S. PATENT DOCUMENTS

| | | | | |
|---|---|---|---|---|
| 3,893,279 | A * | 7/1975 | Bostrom | B65B 11/585 53/461 |
| 7,216,706 | B2 | 5/2007 | Echols et al. | |
| 7,832,585 | B2 * | 11/2010 | Sambrailo | B65D 43/162 220/366.1 |
| 7,900,775 | B2 * | 3/2011 | Hojholt | B65D 71/0088 206/600 |
| 8,322,571 | B2 | 12/2012 | Hovinen et al. | |
| 8,729,437 | B2 | 5/2014 | Gorman et al. | |
| 8,987,844 | B2 | 3/2015 | Jenkins et al. | |
| 9,120,616 | B2 | 9/2015 | Ware et al. | |
| 10,118,817 | B2 | 11/2018 | Cargill et al. | |
| 10,532,855 | B2 | 1/2020 | Sanfilippo et al. | |
| 10,835,680 | B2 | 11/2020 | Cowan et al. | |
| 2016/0251155 | A1 * | 9/2016 | Lato | B65D 71/0096 410/98 |
| 2018/0079537 | A1 * | 3/2018 | Lancaster, III | B65B 61/202 |
| 2020/0020920 | A1 | 1/2020 | Dulle et al. | |

FOREIGN PATENT DOCUMENTS

| | | | | |
|---|---|---|---|---|
| DE | 29912047 U1 * | 12/1999 | | B65D 19/38 |
| SE | 464630 B * | 5/1991 | | B65B 11/045 |

* cited by examiner

*Primary Examiner* — Tanzim Imam
(74) *Attorney, Agent, or Firm* — Jackson Walker LLP; Christopher J. Rourk

(57) ABSTRACT

A method for packaging masonry products, comprising stacking the masonry product. Wrapping the masonry product with a packaging film from a first position to a second position below a top of the product. Placing a top sheet on the top of the masonry product, the top sheet forming at least one vent assembly. Wrapping the masonry product and the top sheet with the packaging film below the vent assembly.

18 Claims, 4 Drawing Sheets

VENTED PACKAGING ARRANGEMENT AND METHOD

RELATED APPLICATIONS

The present application is a divisional of U.S. patent application Ser. No. 17/014,847 filed Sep. 8, 2020, which claims priority to and benefit of U.S. Provisional Patent Application No. 62/897,661, filed Sep. 9, 2019, which are hereby incorporated by reference for all purposes as if set forth herein in their entireties.

TECHNICAL FIELD

The present disclosure relates generally to packaging, and more specifically to a vented packaging arrangement and method to prevent efflorescence in manufactured concrete blocks.

BACKGROUND OF THE INVENTION

Efflorescence is a term that is used to describe the crystalline deposit of salts that often develops on the surface of manufactured masonry materials, such as concrete, brick, stucco or natural stone surfaces. This deposit can be caused by exposure of masonry to water, which can cause the formation of calcium carbonate. Existing protective wraps exacerbate the problem of efflorescence.

SUMMARY OF THE INVENTION

A method for packaging masonry products is disclosed that includes stacking the masonry product. The masonry product is wrapped with a packaging film from a first position to a second position below the top of the product. A top sheet is placed on the top of the masonry product, the top sheet forming at least one vent assembly. The masonry product and the top sheet are secured with additional packaging film below the vent assembly.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings may be to scale, but emphasis is placed upon clearly illustrating the principles of the present disclosure. Moreover, in the drawings, like reference numerals designate corresponding parts throughout the several views, and in which.

DETAILED DESCRIPTION OF THE INVENTION

Figure 1:
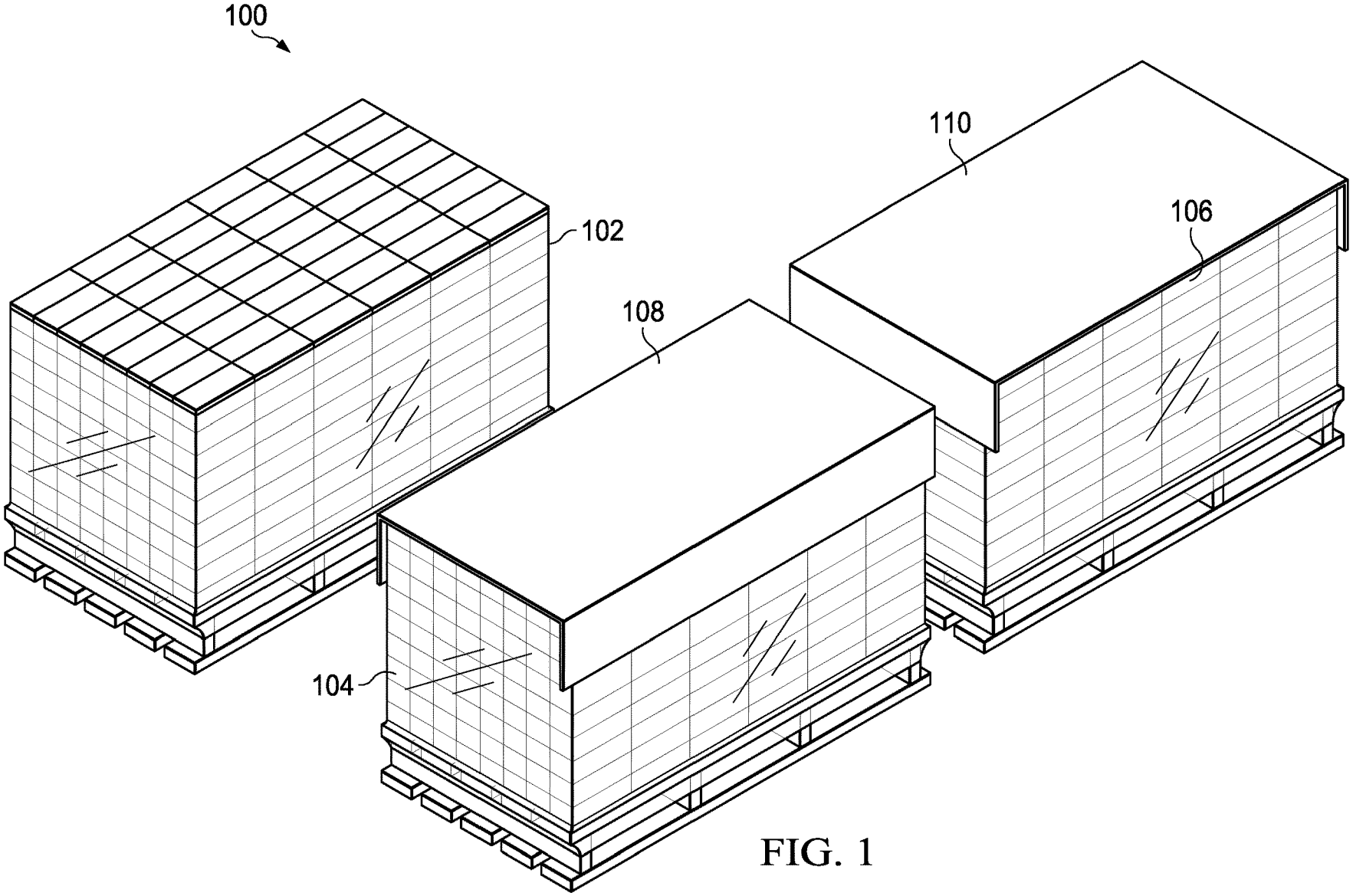
FIG. 1 is a diagram of pallets or stacks of masonry products in stages of packaging, in accordance with an example embodiment of the present disclosure.

In the description that follows, like parts are marked throughout the specification and drawings with the same reference numerals. The drawing figures may be to scale and certain components can be shown in generalized or schematic form and identified by commercial designations in the interest of clarity and conciseness.

The present application claims benefit of and priority to U.S. Provisional Patent Application No. 62/897,661, filed Sep. 9, 2019, which is hereby incorporated by reference for all purposes as if set forth herein in its entirety.

Calcium carbonate efflorescence is known to be the source of unsightly white deposits on surfaces of Portland cement concrete objects and other masonry products, and can be produced by the reaction of calcium hydroxide, itself a product of cement hydration, and atmospheric carbon dioxide. If the reaction occurs within the volume of the product, it can beneficially block pores in the cement paste and reduce permeability. But if the reaction occurs at the surface, evaporite deposits are formed thereon.

Efflorescence is particularly impactful in the Interlocking Concrete Pavement (ICP) industry because ICP is (a) costlier than substitute pavements and (b) generally chosen for appearance. In situ ICP efflorescence is unusual, but efflorescence presenting on Cubed ICP (i.e., a consolidated array of ICP units), prior to sale and installation, is widespread.

The general process causing efflorescence on Cubed ICP is:

- WETTING and ABSORPTION—a portion of the water remains on the unit surface, and a portion of the water is absorbed into the voids of the unit.
- DISSOLUTION and DIFFUSION—surface water dissolves atmospheric carbon dioxide, producing carbonic acid, and absorbed water dissolves calcium hydroxide, producing calcium and hydroxyl ions, which diffuse through the absorbed water into the surface water.
- REACTION and PRECIPITATION—a hydroxyl ion reacts with carbonic acid to produce carbonate, and/or carbonate precipitates with a calcium ion as calcium carbonate.
- EVAPORATION—calcium carbonate crystallizes as surface water evaporates.

Cubed ICP is susceptible to this general process for a number of reasons. First, it is generally stored outdoors for several months, providing numerous wetting opportunities and ample time for absorption, dissolution, and diffusion. In addition, interstices of stacked units, and packaging materials in contact with units, wick and hold surface water and resist drying. In addition, packaging methods that resist wetting (e.g., top-sheets, stretch-wrap) generally also resist drying, and those that promote drying (e.g., banding, perforated stretch-wrap) generally also allow wetting.

Given sufficient wetted time, the efflorescence mechanism will inexorably proceed. The simplest countermeasure is to prevent wetting in the first place. Wetting by precipitation can be avoided by covering the top and sides of Cubed ICP with contiguous impermeable packaging, e.g. 1) a one-piece stretch-hood or shrink-hood, 2) a composite arranged in a water-shedding configuration, comprising 2a) an inner stretch-wrap layer to protect the cube sides from wind-driven rain, 2b) an oversized top-sheet draped outside of the inner stretch-wrap layer, and 2c) an outer stretch-wrap layer to secure the top-sheet's draped edges, or other suitable measures.

Unfortunately, contiguous packaging causes wetting and subsequent efflorescence by evaporation and condensation cycles within the packaging envelope. Particular attributes of Cubed ICP contribute to this mechanism. For example, high moisture content provided by unreacted concrete batch water, high thermal mass, low thermal conductivity between laterally adjacent units (installation spacers are molded into ICP units, forming insulating air gaps therebetween) or high air mobility via the aforementioned gaps, chamfers and embossed surfaces can exacerbate this problem.

During outdoor storage, ICP units in the outer portion of the cube experience a larger diurnal temperature amplitude than units in the inner portion of the cube, which are insulated by the aforementioned gaps and moderated by their large thermal mass. A reversing thermosiphon thereby forms within the packaging envelope. During the day, air rises in the relatively warmer perimeter portions of the cube and sinks in the relatively cooler center portion of the cube. At night, flow reverses, and if the temperature of the packaging falls below the dewpoint of the air rising in the center of the cube, moisture condenses thereon, wetting the units in contact therewith.

The present disclosure provides a solution to these problems, and includes applying impermeable packaging, configured to prevent the ingress of precipitation, to the top and sides of the Cubed ICP. A high-point vent is provided, configured to prevent the ingress of precipitation and to break the thermosiphon. This configuration leads to dehydration of the Cubed ICP over time, because water vapor is discharged through the vent at night instead of being condensed inside the packaging envelope. Packaging materials with high solar reflectance can also be used, to help depower the thermosiphon process.

An assembly that includes a cube or other suitable shape of a suitable number of layers of masonry products is disclosed. Each layer can have a substantially identical height, such as a height between 5 and 11 cm or other suitable heights. Each layer can also have the same size and quantity of units, such as units numbering between 6 and 60, although the arrangement of units from layer to layer may be modified, to provide stability. For example the arrangement of the units in a layer can be rotated 90 degrees, 180 degrees or in other suitable manners. Each unit can include Portland cement concrete blocks having four vertical sidewalls in rectangular (in plan) arrangement, at least one integrally molded spacer on each sidewall, and a chamfer or radius around the top perimeter of the unit, or other suitable configurations. A packaging envelope can include four substantially impermeable sides of extruded film that are configured to prevent the ingress of wind-driven rain, a substantially impermeable top of opaque or reflective material configured to drain runoff therefrom to the outside of the sides of the packaging envelope, and a vent near the top of the packaging envelope configured to prevent the ingress of precipitation and to allow buoyant, warm air that has a high moisture content to escape.

In other embodiments, 1) the vent can be formed by slitting or puncturing a stretch-hood, shrink-hood or other packaging component, 2) the sides of the packaging envelope can be formed by multiple layers of impermeable stretch-wrap and the top can be formed by an impermeable top-sheet, 3) the top-sheet can be white and substantially opaque, 4) the vent can be formed by positioning the upper edge of the stretch-wrap between the lower and upper planes of the top layer in the cube, 5) the vent can be protected from precipitation ingress by an overhang of unsecured top-sheet material on at least one edge of the cube, 6) about half of the layers can be rotated 180 degrees, 7) a wooden shipping pallet or stack or skid can be disposed underneath the blocks, 8) at least one layer can be secured by a strap or band, 9) the top-sheet can be secured by a second series of stretch-wrap turns, 10) the top-sheet can be secured by a band or strap, 11) the top-sheet can be secured on 2 of 4 sides of the cube, 12) the top-sheet can be secured on 3 of 4 sides of the cube, 13) plastic mesh, sand, or beads can be interspersed between layers, 14) the vent can be located on a side of the envelope adjacent the top of the envelope, or other suitable variations or modifications can be provided. These example embodiments are not provided to limit the scope of the disclosure, but to provide different example embodiments that are within the scope of the present disclosure.

Existing packaging for masonry products can result in the trapping of water vapor and its condensation, which can result in the exposure of the masonry products to water. The water can react with calcium hydroxide or other materials in the masonry products, and can result in the formation of calcium carbonate deposits and other deposits that are known as efflorescence.

For example, it is known to surround masonry products with stretch wrap or other packaging materials that form a water barrier. However, these materials can trap water inside of the packaging materials, such as when the masonry products are packaged after manufacture and while they are still in a state or environment in which moisture is present. The moisture can condense inside of the water barrier of the packaging and cause efflorescence.

In addition, stretch wrap materials are known that have weep holes, but these weep holes can allow moisture to enter the package. Because masonry products have substantial thermal capacity, the diurnal cyclic temperatures can cause moisture to be stored within the masonry products during the day and to condense at night, even when there is no precipitation present, but that condition can be exacerbated by the presence of precipitation.

Another problem with known forms of packaging is the use of a cover material, which is often applied after a first layer of a packaging water barrier is applied and which is then held in position with a second layer of a packaging water barrier. This configuration allows precipitation to pool on the top of the cover material and then to enter the packaging at the sides of the packaging. Once in the packaging, the water causes efflorescence.

The present disclosure avoids these problems by providing a cover that is configured to extend for only a short portion along one or more sides. The cover is held in place by its sections that extend along other sides, or possibly by another material such as a strap, but forms an overhang section that prevents precipitation ingress into the packaging and which also allows water vapor with the packaging to escape, using the chimney effect as a motive force. In this manner, water vapor is prevented from condensing within the packaging and efflorescence is also prevented.

FIG. 1 is a diagram 100 of pallets or stacks of masonry products in stages of packaging, in accordance with an example embodiment of the present disclosure. While a pallet with masonry products is referenced herein, the masonry products can also be stacked without a pallet as a base, such as where suitable handling equipment is used to move the stack of masonry product without the need for a pallet or other base. As such, wherever reference to palletized masonry product is made herein, non-palletized masonry product is also intended to be encompassed unless otherwise explicitly stated.

As shown below, a first pallet or stack 102 of masonry product has no top sheet, such as may be formed from polyethylene (PE) or other suitable materials, and has stretch wrap encircling it to a position of 10+/−5 mm below the top surface of the masonry product. A second pallet or stack 104 of masonry product has a PE top sheet 108 that is 48"×60" and opaque white, which is bent over the 32" to 36" wide pallet or stack of masonry product, and which extends 4" on either side of the 52" wide pallet or stack of masonry product. An 8" to 10" section of the side section of PE sheet 108 is secured using stretch wrap, strap, gum band, glue or other suitable materials, and extends to a point 4" below the top surface of the pallet or stack and PE sheet. It is noted that other suitable materials than PE can also or alternatively be used.

A third pallet or stack 106 of masonry product includes a 40"×72" PE white, opaque top sheet 110, which can have bent sides at the opposite ends of the 48" length, and which can extend 2" to 4" over the ends of the 32" to 36" width. Top sheet 110 can be secured in a manner similar to that of the top sheet described above.

In operation, the present disclosure provides a water barrier stretch wrap or other suitable materials for palletized masonry products that can prevent the ingress of precipitation or water, but which has a top PE cover with an overhang and a second layer of stretch wrap or other materials that secure the top cover into position while allowing water vapor to exit the packaging so as to prevent condensation and efflorescence. The present disclosure also provides a method for installing the wrapping material and associated packaging material to prevent water condensation and efflorescence.

Figure 2:
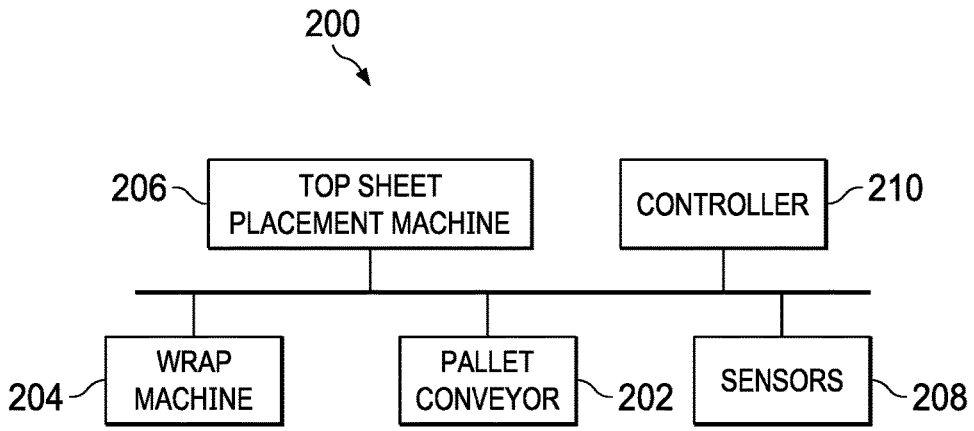
FIG. 2 is a diagram of a system for wrapping pallets or stacks of masonry products, in accordance with an example embodiment of the present disclosure.

FIG. 2 is a diagram of a system 200 for wrapping pallets or stacks of masonry products, in accordance with an example embodiment of the present disclosure. System 200 includes pallet or stack conveyor 202, wrap machine 204, top sheet placement machine 206, sensors 208 and controller 210, each of which can be implemented in hardware or a suitable combination of hardware and software.

Pallet or stack conveyor 202 can include one or more electromechanical devices that are configured to move a pallet or stack of stacked masonry product from a manufacturing system or assembly to a packaging system or assembly. In one example embodiment, pallet or stack conveyor 202 can operate under controls received from controller 210, such as by having one or more controlled devices that are configured to perform predetermined actions in response to external controls, such as motors, pistons, hydraulic devices and so forth. In another example embodiment, pallet or stack conveyor 202 can include a programmable controller that is configured to interface with other controllers, systems or devices using a common control protocol, to implement one or more functions. Pallet or stack conveyor 202 can also or alternatively be configured to move the pallet or stack of stacked masonry products in a coordinated manner, to cooperate with the functions of wrap machine 204 and top sheet placement machine 206 as further described herein, or to perform other suitable functions.

Wrap machine 204 can include one or more electromechanical devices, robotic movement systems or other systems or devices that operate to wrap a pallet or stack of stacked masonry product with a plastic product wrapping material, such as a thin extruded film of PE, polyvinyl chloride (PVC), low-density polyethylene (LDPE), polyvinylidene chloride (PVdC) or other suitable films. In one example embodiment, wrap machine 204 can operate under controls received from controller 210, such as by having one or more control devices that are configured to perform predetermined actions in response to external controls. In another example embodiment, wrap machine 204 can include a programmable controller that is configured to interface with other controllers, systems or devices using a common control protocol. Wrap machine 204 can also or alternatively be configured to move around the pallet or stack of stacked masonry products in a coordinated manner, to cooperate with the functions of pallet or stack conveyor 202 and top sheet placement machine 206 as further described herein, or to perform other suitable functions.

Top sheet placement machine 206 can include one or more electromechanical devices, robotic movement systems or other systems or devices that operate to place one or more sheets of material on top of a pallet or stack of masonry blocks at a predetermined time. In one example embodiment, top sheet placement machine 206 can operate under controls received from controller 210, such as by having one or more control devices that are configured to perform predetermined actions in response to external controls. In another example embodiment, top sheet placement machine 206 can include a programmable controller that is configured to interface with other controllers, systems or devices using a common control protocol. Top sheet placement machine 206 can also or alternatively be configured to pick up a sheet of material having a predetermined size from a first predetermined location and to move the sheet of material to a predetermined location on top of the pallet or stack of stacked masonry products, to bend or form the sheet in accordance with predetermined parameters, to cooperate with the functions of pallet or stack conveyor 202 and wrap machine 204 as further described herein, or to perform other suitable functions.

Sensors 208 are configured to generate one or more sensor inputs for use by pallet or stack conveyor 202, wrap machine 204, top sheet placement machine 206, controller 210 or other suitable systems or components. In one example embodiment, sensors 208 can include image data sensors that are focused at one or more predetermined locations, laser sensors that are configured to scan one or more predetermined locations, radar or sonar system that are configured to detect metal or other solid objects and to generate location data associated with the objects, or other suitable sensors.

Controller 210 can be implemented as one or more algorithms operating on a processor that cause the processor to receive data and commands and to process the data and commands to perform predetermined functions. In one example embodiment, controller 210 can receive data that identifies that a pallet or stack of masonry products is in position to be wrapped by wrap machine 204, and can then generate control data that causes wrap machine 204 to actuate and wrap the pallet or stack of masonry products. In this example embodiment, controller 210 can receive data from sensors 208 and can generate control data to control placement of the wrap from wrap machine 204 as discussed herein, such as to ensure that a gap exists between the top of the pallet or stack of masonry materials and the top of the layer of wrap material. Controller 210 can also be configured to generate control data to cause top sheet placement machine 206 to place a top sheet on the top of the pallet or stack of masonry material, to fold the top sheet and to perform other suitable functions. Controller 210 can further be configured to receive data from sensors 208 that can identify that the top sheet is properly placed and to cause wrap machine 204 to actuate and continue to wrap the pallet. Likewise, controller 204 can be configured to receive data that identifies that the placement of the pallet or stack is incorrect, that the placement of the top sheet is incorrect, that the wrap has been misapplied or that other problems exist, such as to generate a notification for an operator to correct the problem, to move the pallet or stack to a holding area or for other suitable purposes.

In operation, system 200 allows some or all of a pallet or stack packaging operation to be automated. While system 200 is shown as a comprehensive automated system, it can also or alternatively be modified to allow manual operation of one or more functions, but to then allow automated functions to take over to perform other functions.

Figure 3:
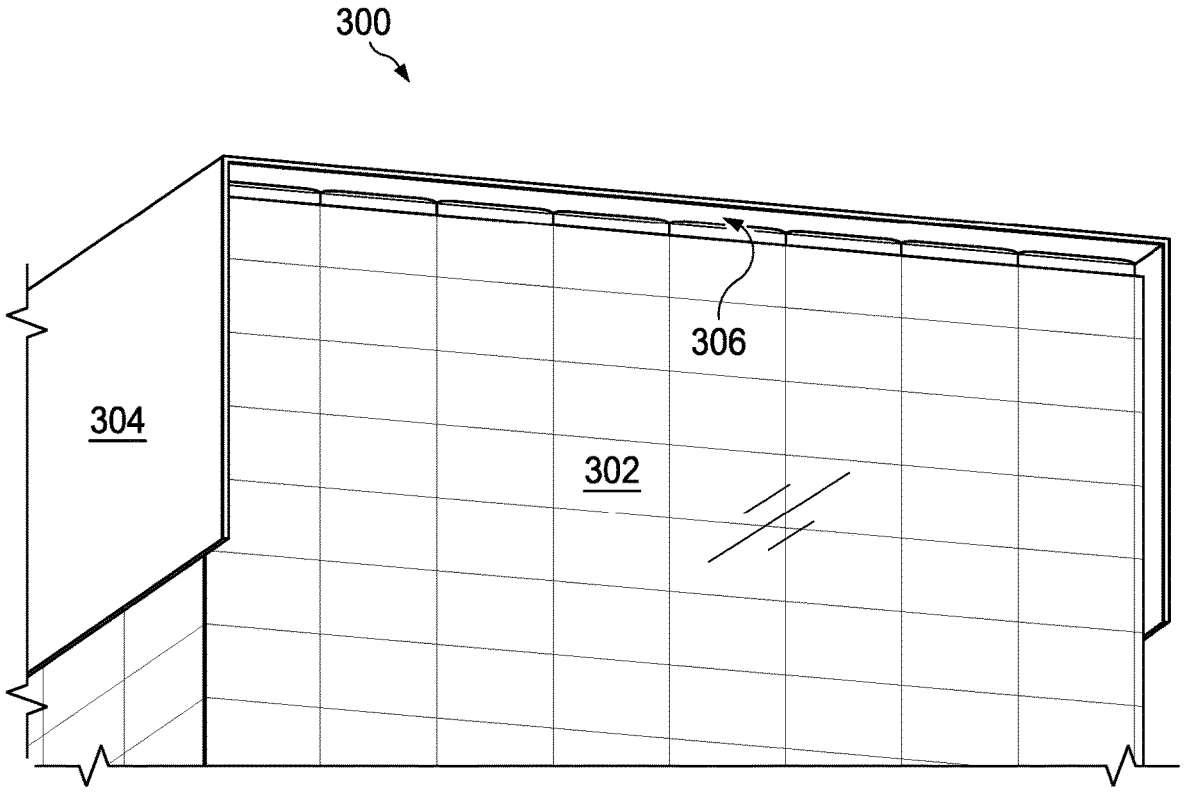
FIG. 3 is a diagram of a close-up of the slot vent formed and the drip edge of top sheet material overhanging it, in accordance with an example embodiment of the present disclosure.

FIG. 3 is a diagram 300 of a close-up of the slot vent 306 that is formed and the drip edge of top sheet material 304 overhanging it, in accordance with an example embodiment of the present disclosure. This slot vent 306 allows water vapor to escape the interior of the pallet or stack of masonry product 302, to prevent condensation and the formation of efflorescence. Slot vent 306 is configured to be easily created during the normal packaging process for the pallet or stack of masonry product 302, so as to minimize the disruption of the existing manufacturing process.

Figure 4:
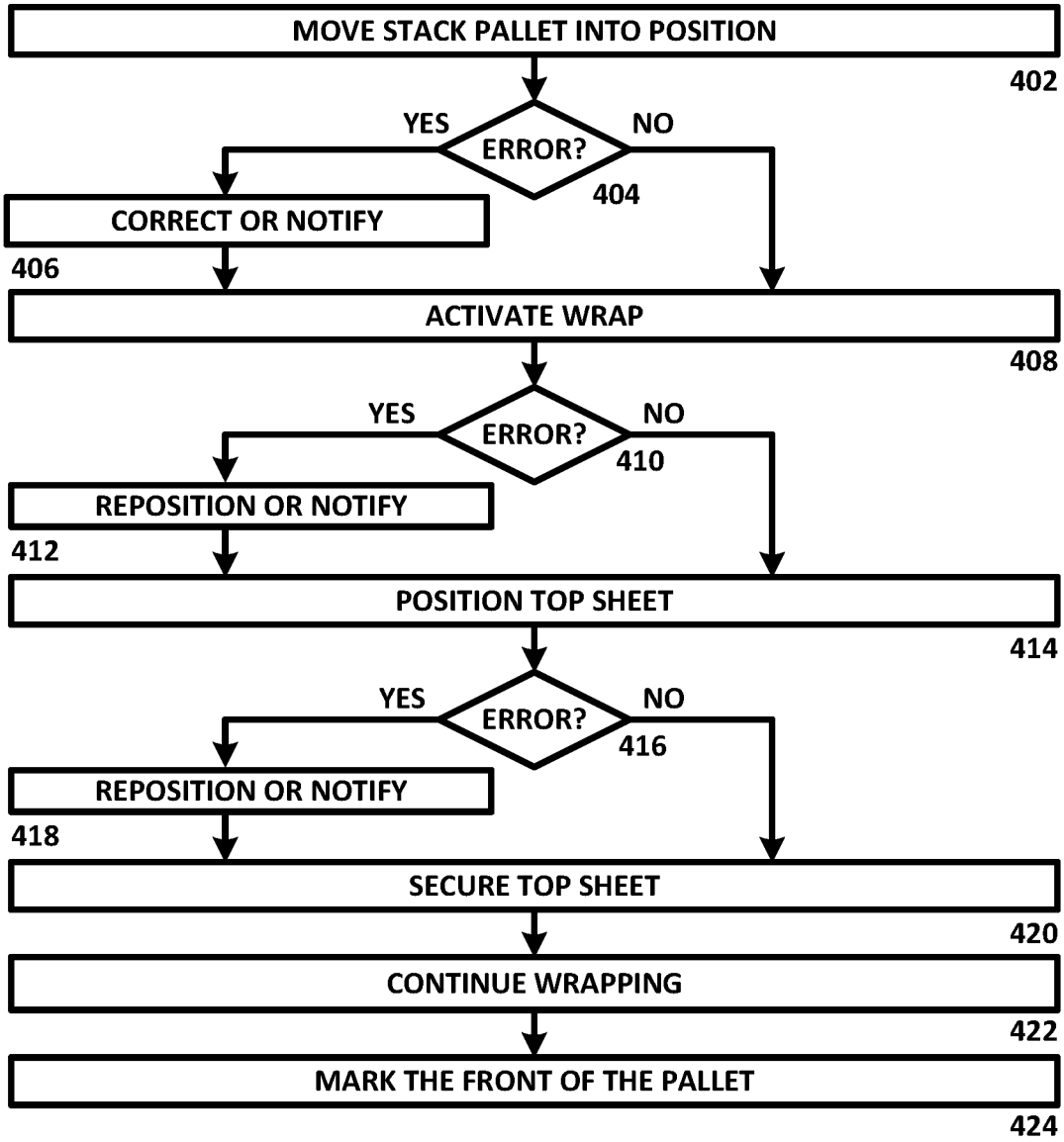
FIG. 4 is a flowchart of a method for providing a protective wrap for masonry products, in accordance with an example embodiment of the present disclosure.

FIG. 4 is a flowchart of a method 400 for providing a protective wrap for masonry products, in accordance with an example embodiment of the present disclosure. Method 400 can be automated, where suitable, and can be implemented as one or more algorithms operating on a programmable controller or other suitable systems or devices.

Algorithm 400 begins at 402, where a pallet or stack of masonry product is moved into position. In one example embodiment, a controller can generate control data that activates a conveyor to move a pallet or stack to a predetermined position, and one or more sensors can generate data that is used by the controller to determine that the pallet or stack has reached its position, such as an image data sensor, a weight sensor, a proximity sensor or other suitable sensors. After the pallet or stack has reached its position, the conveyor system can be deactivated, or other suitable actions can be taken. The algorithm then proceeds to 404.

At 404, it is determined whether there is an error. In one example embodiment, additional sensors can be used to determine if the pallet or stack has moved beyond the position where it should stop, sensors can be used to determine if the pallet or stack is irregular or otherwise damaged, or if other problems exist. If it is determined that there is no error, the algorithm proceeds to 408. Otherwise, the algorithm proceeds to 406 where the error condition is corrected or an operator notification is generated. The algorithm then proceeds to 408.

At 408, a package wrapping machine is activated. In one example embodiment, product packaging wrap such as PVC film is applied to a pallet or stack of masonry blocks, such as by using in-line wrapping equipment that is configured to wrap the PVC film with a minimal overwrap at the top of the pallet or stack of masonry blocks. The algorithm then proceeds to 410.

At 410, it is determined whether there is an error. In one example embodiment, additional sensors can be used to determine if the wrap has been placed in a location where it should not be placed, sensors can be used to determine if the wrap is irregular or otherwise damaged, or if other problems exist. If it is determined that there is no error, the algorithm proceeds to 414. Otherwise, the algorithm proceeds to 412 where the error condition is corrected or an operator notification is generated. The algorithm then proceeds to 414.

At 414, the top of the film is repositioned to a suitable distance below the top of the product, such as 0.5", which can be performed by the wrapping machine, by manual assistance or in other suitable manners. A top sheet of opaque material is then positioned with a short drape at the back of pallet, such as 3" or other suitable lengths, to form a slot vent. One or more of the other three edges can be provided with long drapes, so as to increase the resistance of the packaged pallet or stack to water ingress. The sheet can be pre-formed with the correct dimensions and drapes, a robotic arm or other suitable devices can be used to fold the sheet or other suitable processes can also or alternatively be used. The algorithm then proceeds to 416.

At 416, it is determined whether there is an error. In one example embodiment, additional sensors can be used to determine if the wrap has been placed in a location where it should not be placed, if the top sheet is misplaced or misfolded, sensors can be used to determine if the wrap or top sheet is irregular or otherwise damaged, or if other problems exist. If it is determined that there is no error, the algorithm proceeds to 420. Otherwise, the algorithm proceeds to 418 where the error condition is corrected or an operator notification is generated. The algorithm then proceeds to 420.

At 420, the top sheet is secured into position using ballast blocks, spray adhesives or other suitable devices or materials to help to keep the top sheet in the proper position during subsequent wrapping. The algorithm then proceeds to 422.

At 422, additional wrapping is added to the pallet, such as activating the wrapping machine, while keeping the top of the film a predetermined distance below the top of the product to avoid closing the vent at the back of the pallet, such as 4" or other suitable distances. The algorithm then proceeds to 424.

At 424, a marker is used to mark the pallet or stack to indicate the location of the vent, such as by placing an adhesive marker on the wrapping next to the vent, on the pallet or stack or in other suitable manners. The algorithm then terminates.

In operation, algorithm 400 provides a protective wrap for masonry products, and can be implemented entirely by automated machinery, by a combination of manual and automated processes or in other suitable manners. Although algorithm 400 is shown as a flow chart, it can also or alternatively be implemented as a state machine, using object oriented programming, using a ladder diagram or in other suitable manners.

Figure 5:
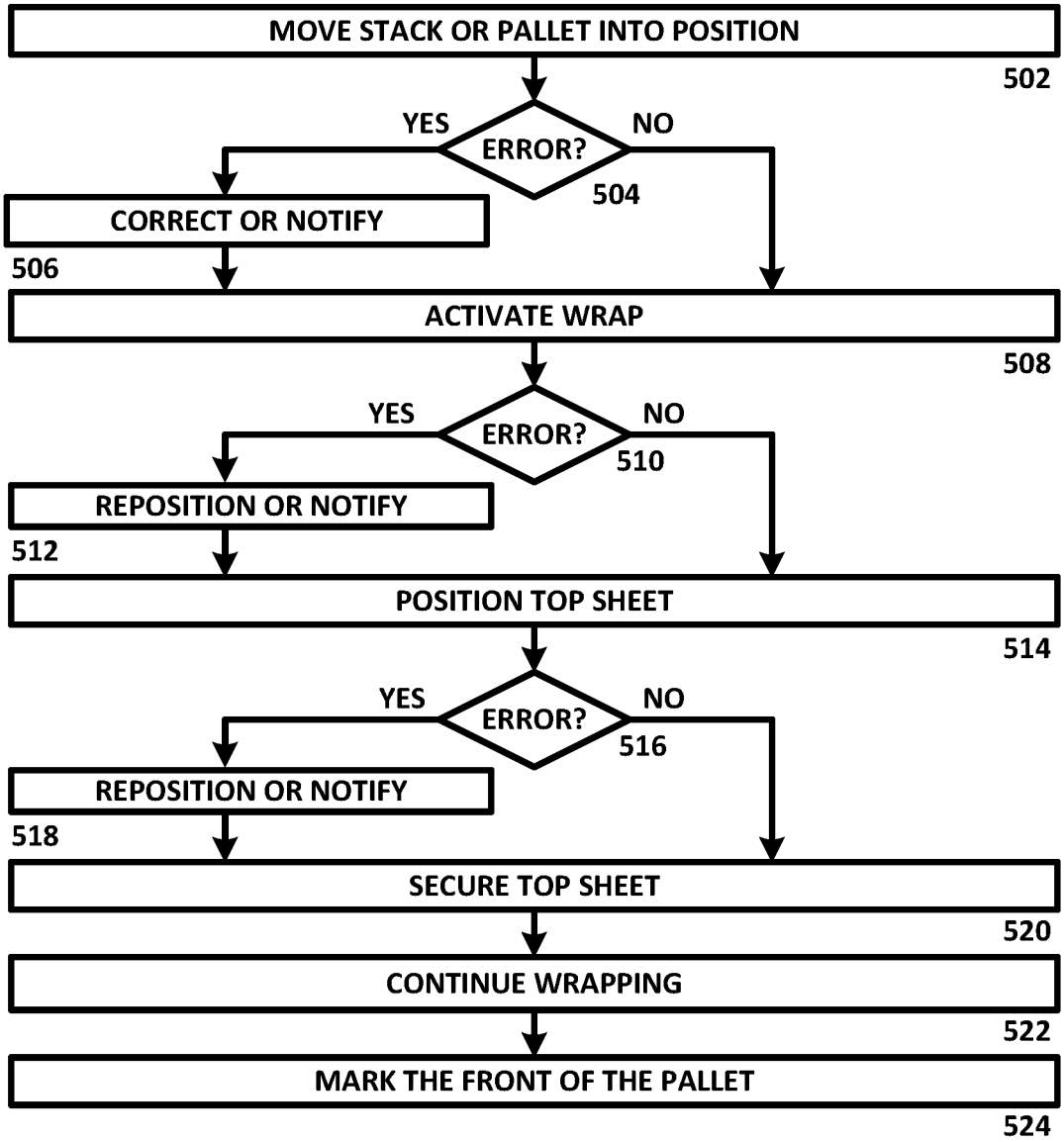
FIG. 5 is a flowchart of a method for providing a protective wrap for masonry products, in accordance with an example embodiment of the present disclosure.

FIG. 5 is a flowchart of a method 500 for providing a protective wrap for masonry products, in accordance with an example embodiment of the present disclosure. Method 500 can be automated, where suitable, and can be implemented as one or more algorithms operating on a programmable controller or other suitable systems or devices.

Algorithm 500 begins at 502, where a pallet or stack of masonry product is moved into position. In one example embodiment, a controller can generate control data that activates a conveyor to move a pallet or stack to a predetermined position, and one or more sensors can generate data that is used by the controller to determine that the pallet or stack has reached its position, such as an image data sensor, a weight sensor, a proximity sensor or other suitable sensors. After the pallet or stack has reached its position, the conveyor system can be deactivated, or other suitable actions can be taken. The algorithm then proceeds to 504.

At 504, it is determined whether there is an error. In one example embodiment, additional sensors can be used to determine if the pallet or stack has moved beyond the position where it should stop, sensors can be used to determine if the pallet or stack is irregular or otherwise damaged, or if other problems exist. If it is determined that there is no error, the algorithm proceeds to 508. Otherwise, the algorithm proceeds to 506 where the error condition is corrected or an operator notification is generated. The algorithm then proceeds to 508.

At 508, a package wrapping machine is activated. In one example embodiment, product packaging wrap such as PVC film is applied to a pallet or stack of masonry blocks, such as by using in-line wrapping equipment that is configured to wrap the PVC film with a minimal overwrap at the top of the pallet or stack of masonry blocks. The algorithm then proceeds to 510.

At 510, it is determined whether there is an error. In one example embodiment, additional sensors can be used to determine if the wrap has been placed in a location where it should not be placed, sensors can be used to determine if the wrap is irregular or otherwise damaged, or if other problems exist. If it is determined that there is no error, the algorithm proceeds to 514. Otherwise, the algorithm proceeds to 512 where the error condition is corrected or an operator notification is generated. The algorithm then proceeds to 514.

At 514, a top sheet of opaque material can be positioned with a short drape at the back of pallet or stack, such as 3" or other suitable lengths. One or more of the other three edges can be provided with long drapes, so as to increase the resistance of the packaged pallet to water ingress. The sheet can be pre-formed with the correct dimensions and drapes, a robotic arm or other suitable devices can be used to fold the sheet or other suitable processes can also or alternatively be used. Likewise, the top sheet can be omitted, where suitable. The algorithm then proceeds to 516.

At 516, it is determined whether there is an error. In one example embodiment, additional sensors can be used to determine if the wrap has been placed in a location where it should not be placed, if the top sheet is misplaced or misfolded (if present), sensors can be used to determine if the wrap or top sheet is irregular or otherwise damaged, or if other problems exist. If it is determined that there is no error, the algorithm proceeds to 520. Otherwise, the algorithm proceeds to 518 where the error condition is corrected or an operator notification is generated. The algorithm then proceeds to 520.

At 520, the top sheet is secured into position using ballast blocks, spray adhesives or other suitable devices or materials to help to keep the top sheet in the proper position during subsequent wrapping, if it is present. The algorithm then proceeds to 522.

At 522, additional wrapping is added to the pallet, such as activating the wrapping machine. The wrapping is then slit at predetermined locations, such as below the top sheet or at a location below the top of the stack, so as to create a vent or vents that release moisture from the package. The algorithm then proceeds to 524.

At 524, a marker is used to mark the pallet to indicate the location of the vent or vents, such as by placing an adhesive marker on the wrapping next to the vent, on the pallet or in other suitable manners. The algorithm then terminates.

In operation, algorithm 500 provides a protective wrap for masonry products, and can be implemented entirely by automated machinery, by a combination of manual and automated processes or in other suitable manners. Although algorithm 500 is shown as a flow chart, it can also or alternatively be implemented as a state machine, using object oriented programming, using a ladder diagram or in other suitable manners.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes one or more microcomputers or other suitable data processing units, memory devices, input-output devices, displays, data input devices such as a keyboard or a mouse, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections. The term "data" can refer to a suitable structure for using, conveying or storing data, such as a data field, a data buffer, a data message having the data value and sender/receiver address data, a control message having the data value and one or more operators that cause the receiving system or component to perform a function using the data, or other suitable hardware or software components for the electronic processing of data.

In general, a software system is a system that operates on a processor to perform predetermined functions in response to predetermined data fields. A software system is typically created as an algorithmic source code by a human programmer, and the source code algorithm is then compiled into a machine language algorithm with the source code algorithm functions, and linked to the specific input/output devices, dynamic link libraries and other specific hardware and software components of a processor, which converts the processor from a general purpose processor into a specific purpose processor. This well-known process for implementing an algorithm using a processor should require no explanation for one of even rudimentary skill in the art. For example, a system can be defined by the function it performs and the data fields that it performs the function on. As used herein, a NAME system, where NAME is typically the name of the general function that is performed by the system, refers to a software system that is configured to operate on a processor and to perform the disclosed function on the disclosed data fields. A system can receive one or more data inputs, such as data fields, user-entered data, control data in response to a user prompt or other suitable data, and can determine an action to take based on an algorithm, such as to proceed to a next algorithmic step if data is received, to repeat a prompt if data is not received, to perform a mathematical operation on two data fields, to sort or display data fields or to perform other suitable well-known algorithmic functions. Unless a specific algorithm is disclosed, then any suitable algorithm that would be known to one of skill in the art for performing the function using the associated data fields is contemplated as falling within the scope of the disclosure. For example, a message system that generates a message that includes a sender address field, a recipient address field and a message field would encompass software operating on a processor that can obtain the sender address field, recipient address field and message field from a suitable system or device of the processor, such as a buffer device or buffer system, can assemble the sender address field, recipient address field and message field into a suitable electronic message format (such as an electronic mail message, a TCP/IP message or any other suitable message format that has a sender address field, a recipient address field and message field), and can transmit the electronic message using electronic messaging systems and devices of the processor over a communications medium, such as a network. One of ordinary skill in the art would be able to provide the specific coding for a specific application based on the foregoing disclosure, which is intended to set forth exemplary embodiments of the present disclosure, and not to provide a tutorial for someone having less than ordinary skill in the art, such as someone who is unfamiliar with programming or processors in a suitable programming language. A specific algorithm for performing a function can be provided in a flow chart form or in other suitable formats, where the data fields and associated functions can be set forth in an exemplary order of operations, where the order can be rearranged as suitable and is not intended to be limiting unless explicitly stated to be limiting.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A method for packaging masonry product, the method comprising:

stacking the masonry product;

wrapping the masonry product with a packaging film from a first position adjacent a bottom of the masonry product to a second position below a top of the masonry product to form at least one vent by not covering at least one exposed side of the masonry product with the packaging film, wherein the at least one exposed side is a portion of a top layer of the masonry product; and placing a top sheet on the top of the masonry product, the top sheet being disposed above the at least one exposed side and not covering the at least one exposed side;

wherein wrapping the masonry product comprises wrapping the masonry product and a folded portion of the top sheet with the packaging film below the at least one vent.

2. The method of claim 1 wherein stacking the masonry product comprises stacking a plurality of layers of the masonry product.

3. The method of claim 1 wherein wrapping the masonry product with the packaging film from the first position to the second position below the top of the masonry product comprises using a wrapping machine to wrap the masonry product.

4. The method of claim 1 wherein placing the top sheet on the top of the masonry product comprises folding at least one side of the top sheet.

5. The method of claim 1 wherein placing the top sheet on the top of the masonry product comprises folding at least two sides of the top sheet.

6. The method of claim 1 wherein placing the top sheet on the top of the masonry product comprises folding at least three sides of the top sheet.

7. A method comprising:

stacking a masonry product;

wrapping the masonry product with a packaging film from a first position to a second position below a top of the masonry product to form a vent by not covering at least one exposed side of the masonry product with the packaging film, wherein the at least one exposed side is a portion of a top layer of the masonry product; and placing a top sheet on the top of the masonry product, the top sheet being disposed above the at least one exposed side and not covering the at least one exposed side, wherein wrapping the masonry product comprises wrapping the masonry product and a folded portion of the top sheet with the packaging film below the vent.

8. The method of claim 7 wherein stacking the masonry product comprises stacking a plurality of layers of the masonry product.

9. The method of claim 7 wherein wrapping the masonry product with the packaging film from the first position to the second position below the top of the masonry product comprises using a wrapping machine to wrap the masonry product.

10. The method of claim 7 wherein placing the top sheet on the top of the masonry product comprises folding at least one side of the top sheet.

11. The method of claim 7 wherein placing the top sheet on the top of the masonry product comprises folding at least two sides of the top sheet.

12. The method of claim 7 wherein placing the top sheet on the top of the masonry product comprises folding at least three sides of the top sheet.

13. A method for packaging masonry product, the method comprising:

stacking the masonry product;

wrapping the masonry product with a packaging film to form at least one vent assembly by not covering a portion of an exposed side of a top layer of the masonry product with the packaging film; and placing a top sheet on a top of the masonry product, the top sheet being disposed above the at least one vent assembly and not covering the at least one vent assembly, wherein wrapping the masonry product comprises wrapping the masonry product and a folded portion of the top sheet with the packaging film below the at least one vent assembly.

14. The method of claim 13 wherein stacking the masonry product comprises stacking a plurality of layers of the masonry product.

15. The method of claim 13 wherein wrapping the masonry product with the packaging film comprises wrapping the masonry product from a first position to a second position below the top of the masonry product using a wrapping machine.

16. The method of claim 13 wherein placing the top sheet on the top of the masonry product comprises folding at least one side of the top sheet.

17. The method of claim 13 wherein placing the top sheet on the top of the masonry product comprises folding at least two sides of the top sheet.

18. The method of claim 13 wherein placing the top sheet on the top of the masonry product comprises folding at least three sides of the top sheet.

* * * * *